US007112918B2

(12) United States Patent
Eden et al.

(10) Patent No.: US 7,112,918 B2
(45) Date of Patent: Sep. 26, 2006

(54) MICRODISCHARGE DEVICES AND ARRAYS HAVING TAPERED MICROCAVITIES

(75) Inventors: J. Gary Eden, Mahomet, IL (US); Sung-Jin Park, Yong-In (KR); Jack Chen, Urbana, IL (US); Chang Liu, Champaign, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 480 days.

(21) Appl. No.: 10/047,469

(22) Filed: Jan. 15, 2002

(65) Prior Publication Data

US 2003/0132693 A1 Jul. 17, 2003

(51) Int. Cl.
*H01J 1/00* (2006.01)

(52) U.S. Cl. ..... 313/356

(58) Field of Classification Search ..... 313/356, 313/618, 631, 632, 498, 567, 574; 257/12, 257/656, 10; 327/87; 438/20
See application file for complete search history.

(56) References Cited

U.S. PATENT DOCUMENTS 4,698,546 A * 10/1987 Maitland et al. ..... 313/446
4,724,356 A * 2/1988 Daehler ..... 313/522
4,858,062 A * 8/1989 Hayakawa et al. ..... 361/225
5,387,805 A * 2/1995 Metzler et al. ..... 257/147
5,686,789 A 11/1997 Schoenbach et al.
5,691,608 A * 11/1997 Yamamoto et al. ..... 315/383
5,723,945 A * 3/1998 Schermerhorn ..... 313/581
5,939,829 A 8/1999 Schoenbach et al.
5,955,828 A * 9/1999 Sadwick et al. ..... 313/310
5,969,378 A * 10/1999 Singh ..... 257/77
5,986,409 A * 11/1999 Farnworth et al. ..... 315/169.4
5,990,620 A * 11/1999 Lepselter ..... 313/585
6,016,027 A * 1/2000 DeTemple et al. ..... 313/356
6,082,294 A 7/2000 Simpson
6,097,145 A * 8/2000 Kastalsky et al. ..... 313/466
6,139,384 A * 10/2000 DeTemple et al. ..... 445/24
6,147,349 A * 11/2000 Ray ..... 250/338.4
6,333,598 B1 * 12/2001 Hsu et al. ..... 313/495
6,695,664 B1 * 2/2004 Eden et al. ..... 445/24
6,815,891 B1 * 11/2004 Eden et al. ..... 313/618
6,828,730 B1 * 12/2004 Eden et al. ..... 313/538
6,867,548 B1 * 3/2005 Eden et al. ..... 315/56

FOREIGN PATENT DOCUMENTS

JP 7192701 7/1995

OTHER PUBLICATIONS

"High-Pressure Hollow Cathode Discharges;" Karl H. Schoenbach et al.; Physical Electronics Research Institute, Old Dominion University, Norfolk, VA, USA; Jun. 30, 1997.
"Microdischarge Devices Fabricated in Silicon;" J.W. Frame et al.; Department of Electrical and Computer Engineering, Everett Laboratory, University of Illinois, Urbana, Illinois, USA; Jun. 30, 1997; App. Phys. Lett. 71 (9), Sep. 1, 1997.

(Continued)

*Primary Examiner*—Karabi Guharay
*Assistant Examiner*—Dalei Dong
(74) *Attorney, Agent, or Firm*—Greer, Burns & Crain, Ltd.

(57) ABSTRACT

A microdischarge device has a semiconductor layer, an intermediate layer, and a conductive layer. A tapered cavity is disposed in at least the semiconductor layer.

55 Claims, 7 Drawing Sheets

OTHER PUBLICATIONS

"Flexible Microdischarge Arrays: Metal/Polymer Devices;" S.-J. Park et al.; Laboratory for Optical Physics and Engineering, Department of Electrical and Computer Engineering, University of Illnois, Urbana, Illinois, USA; May, 17, 2000; Applied Physics Letters, vol. 77, No. 2, Jul. 10, 2000.

"Emission of Excimer Radiation from Direct Current, High-Pressure Hollow Cathode Discharges;" Ahmed El-Habachi and Karl H. Schoenbach; Electrical and Computer Engineering Department, Physical Electronics Research Institute, Old Dominion University, Norfolk, Virginia, USA; Nov. 4, 1997; App. Phys. Lett. 72 (1), Jan. 5, 1998.

"Performance of Microdischarge Devices and Arrays with Screen Electrodes;" S.-J. Park, C.J. Wagner, and J. G. Eden, Fellow, IEEE; IEEE Photonics Technology Letters, vol. 13, No. 1, Jan. 2001.

* cited by examiner

MICRODISCHARGE DEVICES AND ARRAYS HAVING TAPERED MICROCAVITIES

STATEMENT OF GOVERNMENT INTEREST

This invention was made with Government support under Contract Number F49620-00-1-0372 awarded by Air Force Office of Scientific Research (AFOSR). The Government has certain rights in the invention.

BACKGROUND

The present invention relates to microdischarge devices and, in particular, to novel structures for light emitting devices. It has long been known that electrical discharges are efficient sources of light, and today gas discharge lamps (including fluorescent sources, and metal-halide, sodium, or mercury arc lamps) account for most of the world's light-generating capacity (several billion watts on a continuous basis). Most of these devices are, unfortunately, bulky and frequently have fragile quartz or glass envelopes and require expensive mounting fixtures. In addition to general lighting, discharges produce ultraviolet and visible light for other purposes, such as germicidal applications (disinfecting surfaces and tissue), cleaning electronic and optical surfaces in manufacturing, curing polymers and activating light-sensitive molecules for medical treatments and diagnostics.

Although discharge devices were apparently first demonstrated by A. D. White in 1959, only recently were microdischarge devices fabricated in silicon by techniques developed in the integrated-circuit industry. As shown in FIG. 1, and see, for example, U.S. Pat. No. 6,016,027, a conventional microdischarge device 100 fabricated in silicon has a cylindrical cavity 102 in the cathode 104 of the device 100. The semiconductor cathode 104 was affixed to a copper heat sink with conductive epoxy. The anode 106 for the microdischarge device 100 was typically a metal film such as Ni/Cr. A thin dielectric layer 108 deposited onto the silicon electrically insulates the cathode 104 from the anode 106. When the cavity 102 is filled with the desired gas and the appropriate voltage imposed between the cathode 104 and the anode 106, a discharge is ignited in the cavity 102.

Microdischarges have several distinct advantages over conventional discharges. Since the diameter of single cylindrical microdischarge devices, for example, is typically less than 400–500 μm, each device offers the spatial resolution that is desirable for a pixel in a display. Also, the small physical dimensions of microdischarges allows them to operate at pressures much higher than those accessible to conventional, macroscopic discharges. When the diameter of a cylindrical microdischarge device is, for example, on the order of 200–300 μm, the device will operate at pressures as high as atmospheric pressure and beyond. Furthermore, at these high pressures, the microdischarge produces a stable, uniform glow. In contrast, standard fluorescent lamps, for example, operate at pressures typically less than 1% of atmospheric pressure.

Despite their applications in several areas, including optoelectronics and sensors, microdischarge devices can have several drawbacks. For example, the lifetime of the devices is exceedingly short, operating for only a few tens of hours. Damage to the anode is quickly visible and is caused by sputtering. Extracting optical power from deep cylindrical cavities is also frequently inefficient. If the cylindrical cathode for a microdischarge is too deep, it will be difficult for photons produced below the surface of the cathode to escape. In addition, conventional microdischarge devices may require fabrication techniques such as mechanical drilling and ablation. The use of these techniques limits the minimum size of the cavity diameter, thereby limiting the resolution of the devices. Furthermore, scaling an array of the devices is difficult as devices at the perimeter of large arrays may ignite preferentially.

BRIEF SUMMARY

A microdischarge device comprises a first layer having a tapered cavity disposed therein, an intermediate layer on the first layer, and a second layer on the intermediate layer. The intermediate layer electrically insulates the first layer from the second layer with the first and second layer having a conductivity larger than that of the intermediate layer.

The side walls of the cavity may be coated with a reflective material that substantially reflects light of interest. The intermediate layer may be a depletion region of a diode or may be one or more dielectric layers. The second layer may comprise an electrically conducting screen disposed on an end of the cavity. An optically transmissive sealing material may seal the cavity. The cavity may have an inverted square pyramidal shape.

Single microdischarge devices or arrays of microdischarge devices may be fabricated.

DETAILED DESCRIPTION

The present invention provides microdischarge devices and arrays of microdischarge devices that have tapered cavities. Tapered cavities are relatively inexpensive and easy to fabricate using conventional semiconductor processing techniques. The present devices may thus be inexpensive to manufacture and have superior electrical and optical characteristics and lifetimes compared to those of conventional microdischarge devices.

The large positive differential resistance of devices with tapered arrays decreases power consumption, while the linearity of the V–I characteristics, including the preservation of the voltage across the device when ignition of the discharge occurs, permits self-ballasting of the devices and simplifies external control circuitry. Microdischarge devices with tapered cavities also exhibit an increase in surface area and permit a shallow hollow cathode relative to a conventional planar structure to be fabricated, thereby enabling easy modification of the electrical properties of devices as desired. In addition, increased output efficiencies are obtained by coating the tapered side walls with an optically reflective conductive coating or a coating with a relatively small work function.

Stable and continuous glow discharges are produced at voltages below the standard wallplug voltage of 120 V even with gas pressures exceeding an atmosphere. Similarly, devices show a linear variation of output power without saturation and high radiative efficiency. Arrays of the devices produce considerable output power and exhibit ignition characteristics superior to those of conventional arrays of devices.

Figure 1:
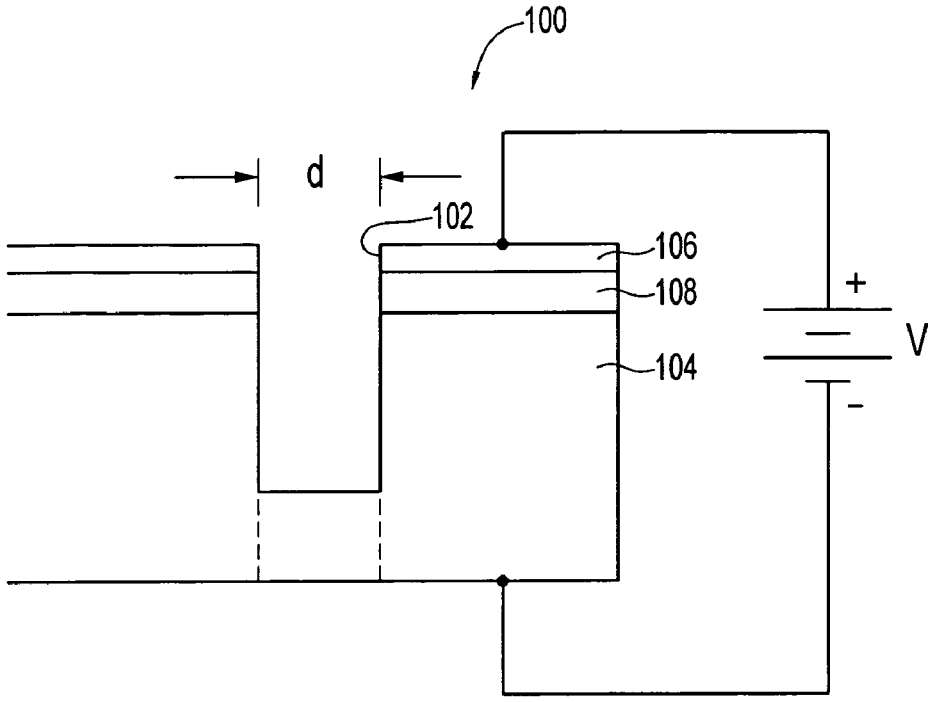
FIG. 1 is a cross-sectional view of a conventional microdischarge device.
Figure 2B:
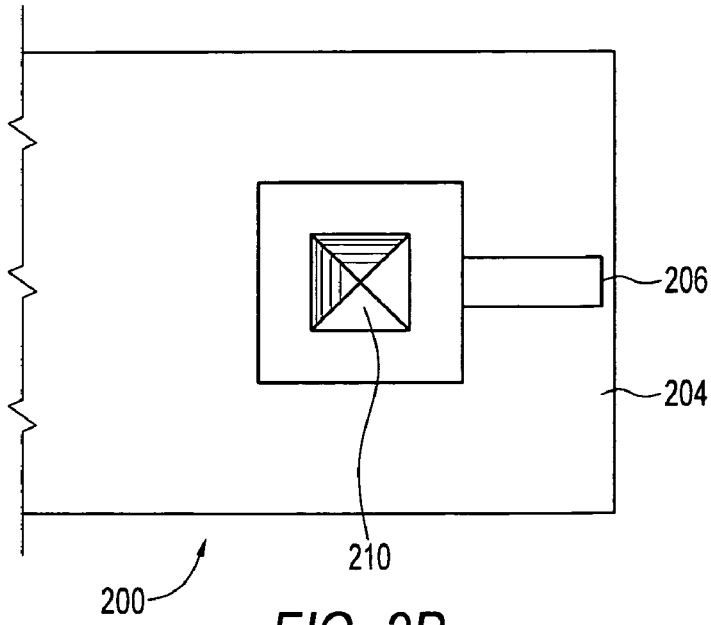
FIGS. 2*a* and 2*b* are cross-sectional and top views, respectively, of an embodiment of the microdischarge device of the present invention.
Figure 2A:
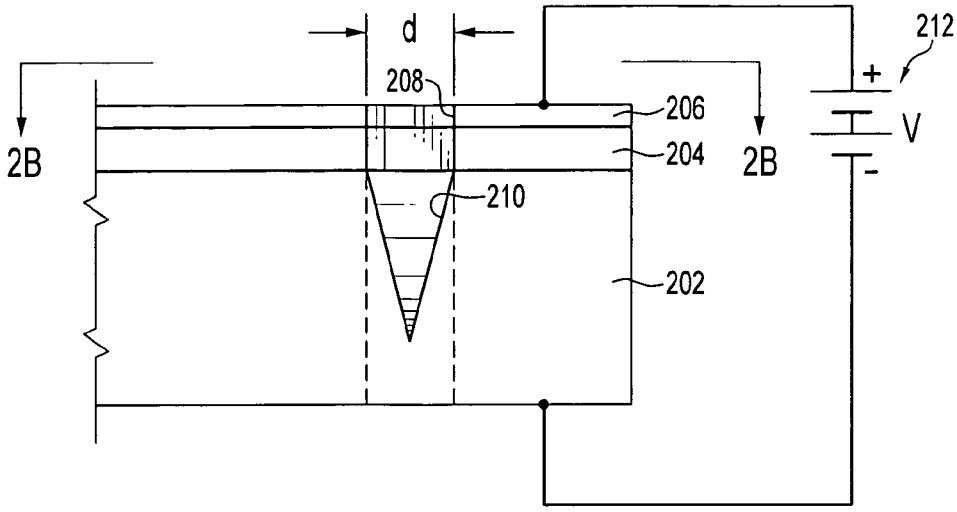

A first embodiment of a microdischarge device (not drawn to scale) is shown in FIGS. 2*a* and 2*b*. The microdischarge device 200 has a semiconductor layer 202, an intermediate layer 204 on the semiconductor layer 202, and a conductive layer 206 on the intermediate layer 204. A cavity 208 is formed in the semiconductor layer 202, the intermediate layer 204 and the conductive layer 206. The total thickness of the semiconductor layer 202, the intermediate layer 204 and the conductive layer 206 is quite thin, preferably at most 1 mm.

As shown in FIGS. 2*a* and 2*b*, the cavity 208 has a tapered shape formed in a direction transverse to the layers in which it is present. A tapered cavity is a cavity in which the cross-sectional surface area of the cavity decreases from the surface of the layer in which the tapering of the cavity begins. More specifically, the tapered cavity may be defined such that the midpoint cross-sectional area is not greater than 90% of the cross-sectional area of the cavity at the surface of the layer in which the tapering of the cavity begins. The midpoint cross-sectional area is the cross-sectional area of the cavity at a depth of one-half the total depth from the surface of the layer in which the tapering of the cavity begins to the bottom of the cavity. Preferable ranges of the midpoint cross-sectional area include not greater than 80%, 70%, 60% or 50% of the cross-sectional area of the cavity at the surface of the layer in which the tapering of the cavity begins. Alternatively, the angle of the taper (i.e. from either the bottom of the cavity, if the cavity terminates substantially at a point, or the midpoint of the bottom of the cavity, if the cavity does not terminate substantially at a point, to a line normal to the surface of the layer in which the tapering of the cavity begins) is not less than 5 degrees and not greater than 60 degrees. Preferable ranges of this angle also include not less than 10 degrees to not more than 50 degrees, not less than 20 degrees to not more than 45 degrees or not less than 30 degrees to not more than 40 degrees.

Preferably, the shape of the cavity 208 is that of an inverted square pyramidal. Of course, other shapes are also possible, depending on the semiconductor material or processing used. The cavity preferably has an area of at most 300 μm square at the base. More preferably, the area is not more than 100 μm square at the base or the area is not more than 50 μm square at the base. Note that discharge devices have an area of at least $10^7$ $\mu m^2$ whereas microdischarge devices typically have an area of at most $10^6$ $\mu m^2$ and preferably have areas of at most $10^5$ $\mu m^2$, at most $5\times10^4$ $\mu m^2$, at most $10^4$ $\mu m^2$, and at most $5\times10^3$ $\mu m^2$. The cavity 208 may extend through the semiconductor layer 202 (for example, forming a square pyramidal shape with a flat top) or may terminate therewithin. The depth of the cavity 208 is dependent on the area at the base (i.e. at the surface of the semiconductor layer 202). For example, the depth of a square pyramidal cavity in silicon fabricated having an area of 100 μm square at the base is 70 μm, while that of a cavity having an area of 50 μm square was 35 μm. Typical sizes of the base of the pyramid are 10–200 μm square.

The cavity 208 is preferably formed using conventional semiconductor photolithographic processing techniques. Anisotropic wet chemical etching is preferably used as it is a well-established technique that is simple, inexpensive and, for example, able to reliably form pyramids in Si. The pyramidal shape of the cavity is caused by the difference in the etch rates of the etchant along the different crystalline planes of Si. Similarly, the shape of the cavity also depends on the semiconductor material used due to the disparity in the etch rates along the different crystalline planes in different material systems.

Wet chemical etching and other conventional semiconductor fabrication processes are well known in the semiconductor and MEMS fields and will not be discussed. Other techniques such as drilling using different drill bit sizes or varying laser spot sizes/shapes may alternately be used to form a tapered cavity. However, these techniques may be relatively more costly and time consuming than conventional semiconductor photolithographic processing techniques.

The cavity is filled with a gas selected for its breakdown voltage or light emission properties at breakdown. Light is produced when the voltage difference between the conductive and semiconductor layers creates an electric field in the portion of the cavity 208 in the intermediate region 204 sufficiently large to electrically break down the gas (nominally about $10^4$ V/cm). This light escapes from the cavity 208 through at least one end of the cavity 208. Either DC or AC voltages may be applied to produce the discharge.

The gas that fills the cavity 208 may be selected for its light emission properties at breakdown. The term gas, as used herein, refers to acceptable single gases, gas mixtures, and vapors. Examples of gases are the rare gases (He, Ne, Ar, Xe, and Kr), and $N_2$. In addition, a wide variety of gas mixtures exist that, when excited, also produce intense emission from atomic or molecular species. An example of the former is Ar/Hg vapor and the latter includes rare gas/halogen donor gas mixtures (such as one or more rare gases mixed with $F_2$, $NF_3$, $XeF_2$, $N_2F_4$, HCl, $Cl_2$, $I_2$, HI or other halogen-bearing molecules). Another example is the XeO (xenon oxide) excimer that is produced in mixtures of Xe and $O_2$, $N_2O$ or $NO_2$ gases. Such gases, however, need not be present in the cavity: breakdown may occur when air is present.

The shape of the cavity 208 exposes the tapered side walls 210 from the top of the device 200. This permits the tapered side walls 210 that form the cavity 208 to be coated with at least one thin film of material(s) that may be conductive and reflect light in the spectral region of interest, thereby improving efficiency for extracting light from the device.

Alternatively, the thin films may have a relatively small work function and high secondary electron coefficient. This permits positive ions in the plasma to produce electrons relatively easily when impinging on the coating, thereby increasing the electrons available for extraction or for further ionization of the gas. Both types of thin films are well known in the art and will not be described here. The coating may be deposited immediately after the cavity 208 is etched and the excess coating on the photoresist (not shown) that defines the cavity 208 lifted off with the photoresist.

Although FIG. 2*a* illustrates the cavity 208 as being formed from the surface of the conductive layer 206, extending through the conductive layer 206, the intermediate layer 204 and the semiconductor layer 202, the cavity 208 may be formed only in the intermediate layer 204 and the semiconductor layer 202. The cavity may preferably terminate before extending through both surfaces of the semiconductor layer 202.

The top end of the cavity 208 may also have a cylindrical chamfered region (not shown) formed e.g. by mechanical, ultrasonic, or laser drilling. This chamfered region may make it easier to couple to optical fiber, for example. The annular chamfer may widen the cavity 208 such that the optical fiber may be accommodated therein. Note that in this embodiment, as others, the conductive layer may be grounded while a pulsed or CW voltage is applied to the semiconductor layer. This configuration allows for efficient optical coupling of the discharge into the fiber because the fiber core diameter can be selected to be equal to or greater than that of the cavity 208. The fiber, in turn, may be any conventional fiber, such as an appropriately doped fiber that serves as a fluorescence converter. One example of such a fiber is a Ho:ZBLAN fiber, which converts red light from a Ne microdischarge into green light. An example of an application using the coupled fibers is a fiber bundle used to transport radiation from an array of devices (as described below) to another location in which one fiber is used per device.

The semiconductor layer 202 is electrically conductive. Preferably, the semiconductor material that forms the semiconductor layer 202 has a resistivity of at most 50 Ω-cm, more preferably at most 25 Ω-cm, 10 Ω-cm or 5 Ω-cm. An electric field is established in the cavity 208, across the intermediate layer 204, by a voltage source 212 connected between the semiconductor layer 202 and the conductive layer 206. The semiconductor layer 202 and the conductive layer 206 serve as electrodes for the device 200. Ohmic contacts to the semiconductor layer 202 and the conductive layer 206 that permit an external voltage to be applied to the layers are not shown. The potential difference across the intermediate layer 204 creates a discharge in the cavity 208, typically when a gas is present in the cavity 208. The resulting light has emission spectra that are characteristic of the gas or gas mixture selected. This light is subsequently emitted from at least one end of the cavity 208.

The semiconductor layer 202 is planar and may be fabricated on a base material, such as an insulating or conducting substrate, or may be fabricated from a semiconductor substrate. In the former case, the semiconductor layer may be grown on the substrate by deposition such as chemical vapor deposition (CVD) including metal-organic chemical vapor deposition (MOCVD), molecular beam epitaxy (MBE), liquid phase epitaxy (LPE), vapor phase epitaxy (VPE) or any other technique known in the art. In the latter case, the semiconductor layer may be fabricated by other techniques known in the art, such as diffusion into an insulating substrate. The doping of the semiconductor layer is determined according to the device design. For example, the semiconductor layer may doped in excess of about $10^{18}$ $cm^{-3}$ to allow easier/better contact between the semiconductor layer and the voltage source 212. Preferably, a deposited semiconductor layer has a thickness of at most 100 μm, more preferably a thickness from 10 Å to 100 μm or from 50 Å to 50 μm. Preferably, a semiconductor layer formed from a substrate has a thickness of at most 500 μm, more preferably a thickness from 100 μm to 500 μm or from 200 μm to 400 μm. The semiconductor layer 202 preferably serves as the cathode of the device 200 and the conductive layer 206 serves as the anode of the device 200.

The semiconductor layer is typically silicon as silicon is inexpensive and fabrication techniques are well known. However, other elemental and compound semiconductors may be used, including column IV semiconductors such as Ge and diamond, and SiGe, SiC, III–V semiconductors such as GaAs, InP, GaN, and ternary and quaternary compounds, II–VI semiconductors such as ZnSe. Similarly, semiconducting polymers may be used. The use of these materials may be advantageous for various systems. Similarly, the types of materials and methods to make ohmic contact to the semiconductor layer 202 are well-known in the art of semiconductor device fabrication and will not be discussed.

Additionally, the semiconductor layer may be an optically transmissive material that does not substantially absorb light of a selected wavelength emitted by the gas when the gas is excited. Optically transmissive material transmits preferably at least 50% of the impinging light substantially normal to the surface of the material at a particular wavelength of the discharge. More preferably, optically transmissive material transmits at least 60%, 70%, 80%, 90%, or 95% of light impinging substantially normal to the surface of the material at wavelength of the discharge. One example of such a semiconductor layer is silicon carbide (SiC), which is highly transmissive to visible light.

The intermediate layer 204 may be formed from a dielectric material. Such a dielectric layer is formed of a material with a resistivity of at least 0.1 Ω/cm, preferably from 0.5 Ω-cm-100 Ω-cm or from 1.0 Ω-cm-10.0 Ω-cm. The dielectric layer 204 acts as an insulator to electrically isolate the conductive layer 506 from the semiconductor layer 202. Preferably, the dielectric layer 204 has excellent thermostability and high dielectric strength, e.g. $T_g$>200° C. and at least $10^4$ V/cm, respectively. More preferable ranges for the thermostability include 400° C.>$T_g$>250° C. and 350° C.>$T_g$>275° C. and for the dielectric strength from $5\times10^4$ V/cm-$5\times10^6$ V/cm or $10^5$ V/cm-$5\times10^5$ V/cm. The dielectric layer 204 may be formed by growing, evaporating, spin coating, attaching with conductive paste or otherwise depositing a film onto the semiconductor layer 202.

The dielectric layer 204 may be formed from oxide and nitride films such as $SiO_2$ or $Si_3N_4$ or a polymer such as polyimide, which has exceptional thermostability and dielectric strength. For example, the breakdown voltage for a polyimide film about 5 μm thick is approximately 1.2 kV, giving a dielectric strength in excess of $10^6$ V/cm. Other dielectrics, resins and polymers, for example KAPTON, may be used as long as the material retains its insulation properties at the material thickness required for adequate dielectric strength.

In addition, multiple films of different materials (having at least one different dielectric constant) may be used to fabricate the dielectric layer 204 in order to improve both individual device and array performance. Measurements have shown that a multiple layer dielectric (containing, for example, ~0.5 μm $Si_3N_4$, 0.5 μm $SiO_2$, and several microns of polyimide) not only improves the voltage-current characteristics of an individual microdischarge device but also makes it possible to realize stable operation of large arrays (for example, 30×30) of devices. If, on the other hand, the dielectric layer 204 is a single film of polyimide, for example, it is difficult to operate arrays larger than approximately 5×5.

The dielectric layer 204, in addition to the conductive layer 206, may also be thin, preferably at most 100 μm. Preferred thickness ranges for the dielectric layer 204 may be from 10 Å to 100 μm or 100 Å to 10 μm. The potential difference established between the semiconductor layer 202 and the conductive layer 206 creates an electric field whose strength is inversely proportional to the thickness of the dielectric layer 204. Scaling the thickness of the dielectric layer 204 thus changes the magnitude of the electric field in that region.

The conductive layer 206 is fabricated from a material that has good electrical and thermal conductivity. The conductive layer 206 may be planar and fabricated from one or more thin layers of conductive material. The conductive layer 206 may be about the same thickness as the semiconductor layer 202, but is preferably thinner than the semiconductor layer 202. Common metals that may be used include copper, aluminum, gold, silver, nickel, and zinc and alloys thereof. Other conductors include polymers containing carbon black and other conducting polymer materials or highly doped crystalline, polycrystalline or amorphous semiconductor films such as Si. In addition, rather than the conductive layer being formed from an optically opaque material, it may also be fabricated from a solid layer of an optically-transmissive material (at the wavelength of the discharge) such as ITO.

The conductive layer 206 may also be fabricated from multiple layers, at least one of which (preferably the layer closest to the discharge) is electrically conducting. The other layers may serve as a mirror to reflect light of undesired wavelengths back into the microdischarge. The conductive layer 206 is preferably sputtered, plated, or otherwise disposed onto the dielectric layer 204 to establish a film of conducting material around the rim of the cavity 208 in the dielectric layer 204.

Figure 3:
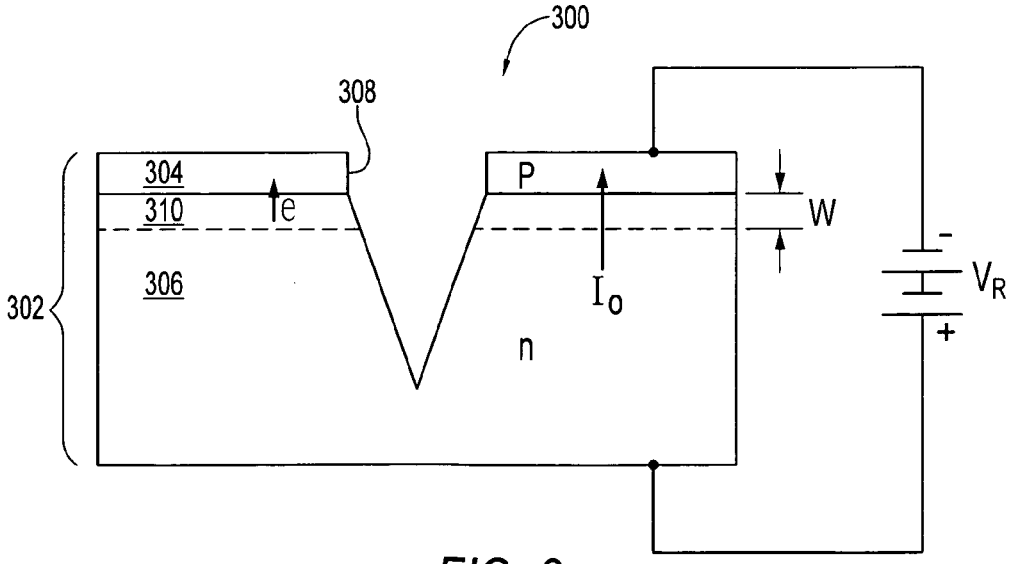
FIG. 3 is a cross-sectional view of an embodiment of the microdischarge device of the present invention.

In another embodiment, shown in FIG. 3, the microdischarge device 300 may be formed from a diode 302. The diode 302 has a p-type semiconductor layer 304 and an n-type semiconductor layer 306. A cavity 308 is formed through the depletion region 310 of the diode 302 and the surface of at least one of the semiconductor layers 304 and 306. Essentially, the semiconductor layer that forms the anode serves as the conductive layer of FIG. 2*a*, while the depletion region serves as the intermediate layer. The diodes are reverse-biased to ignite gas in the cavity formed by the depletion region, where the majority of the electric field resides.

The two semiconductor layers may be formed of similar materials and have similar mechanical properties and may be formed by the same methods as the semiconductor layer of FIG. 2*a*. Alternatively, the properties of the two semiconductor layers may be different: for example, the anode layer may be much thinner than the cathode layer (similar to the conductive layer of FIG. 2*a* being thinner than the semiconductor layer) or may be of a different material.

A diode has device characteristics such that application of a voltage that forward biases the diode (say 1 V) exhibits a superlinear change in current from the application of a voltage having the same magnitude but opposite sign (i.e. −1 V) that reverse biases the diode. Prior microdischarge devices using dielectric layers do not exhibit such superlinear changes in corresponding voltage ranges, for example from 1 V to −1 V, as the dielectric material exhibits a large resistance with an applied voltage of either sign. In general, forward biased diodes exhibit an exponential increase in current with increasing forward bias. Resistances of the diode in the forward active region of operation are usually negligible compared with connected external resistances. Under reverse bias, the increase of current with increasing reverse bias voltage is generally extremely small, typically being essentially constant, until breakdown of the diode is reached. Note that, however, the breakdown of diodes varies widely with the type of diode: the breakdown of Zener diodes, for example may occur at a reverse bias of only a few volts while that of other diodes may be hundreds of volts. In addition, the diode may be part of a bipolar junction transistor (BJT) or semiconductor controlled rectifier (SCR), both of which comprise at least two p-n semiconductor diodes, or a field effect transistor (FET), which comprises two metal-semiconductor junction diodes.

It is well known that the width of the depletion region (W) varies with the reverse bias voltage, $V_R$, of the diode, specifically W is proportional to $V_R^{1/2}$ where $V_R$ is the magnitude of the reverse bias applied to the diode. In addition, the reverse bias current, $I_0$, is essentially independent of $V_R$ until breakdown is reached. Gas intentionally introduced into the cavity may produce a discharge of different wavelengths, as mentioned above. This is possible as a majority of the reverse bias applied to the diode appears across the depletion region, thereby increasing the electric field strength proportionally.

As the reverse bias current $I_0$ is essentially insensitive to the reverse bias voltage, varying the reverse bias voltage impacts primarily the microdischarge. Increasing the reverse bias voltage increases the depletion width and thus decreases the junction capacitance. Thus, for a selected gas or mixture of gases, the properties of the p-n junction (e.g. the reverse breakdown voltage, doping levels in the semiconductor layers) can be designed and the optimum value of the reverse breakdown voltage determined for excitation of the gas. The reverse breakdown voltage, in turn, dictates the maximum electric field in the cavity.

One of the advantages of this device is the ability to effect simultaneous control over both the shunt capacitance of the reverse biased p-n junction and the discharge E/N ratio. The discharge E/N ratio is the ratio of the electric field strength in the cavity and the atomic or molecular number density of the gas. The reason for this is that the above ratio is proportional to $V_R^{1/2}$, while the capacitance is inversely proportional to the depletion width, i.e. $V_R^{-1/2}$, and thus the product of the two is approximately constant. This allows for a greater design flexibility for radio-frequency (RF) modulation of both individual microdischarge devices and arrays of devices. That is, to excite a microdischarge at radio frequencies, for example, one can match the shunt capacitance of the reverse-biased junction, $C_j$, with an external inductor to resonantly drive the microdischarge at the desired frequency.

Another advantage of the diode of FIG. 3 is that the entire device may be fabricated from Si, or any other structure capable of forming a depletion region. Other, non-exclusive examples of such a structure include homojunctions of elemental semiconductors such as Ge and diamond, compound semiconductors (including III–V and II–VI) such as SiGe, SiC, GaAs, GaN, semiconducting polymers, or heterojunctions of Si/Ge, GaAs/AlGaAs, and InP/InGaAs, for example. This makes the fabrication of the device simple and inexpensive. For example, entire silicon wafers having a p-n junction parallel to their surfaces are produced by well-known processes, such as diffusion. The replacement of the conventional dielectric layer with the depletion region reduces the cost significantly and simplifies the production of the devices as the cavity is fabricated through only one type of material. As above, the cavity may be formed by mechanical or ultrasonic drilling, optical drilling (preferably by a pulsed laser), or preferably by dry etching or wet etching of the layers.

While the above embodiment is directed towards a p-n junction diode, similar results may be obtained using a Schottky diode. The Schottky diode has a metal layer disposed on a semiconductor layer. For an n-type semiconductor layer, the work function for the semiconductor is smaller than the work function for the metal. For a p-type semiconductor layer, the work function for the semiconductor is larger than the work function for the metal. Any conventional metal may be used that forms a depletion region on the base semiconductor layer when the proper bias voltage is applied. Examples of Schottky diodes include Al on n-type Si.

In a similar embodiment to the diode of FIG. 3, an intermediate semiconductor layer may be formed between the p-type and n-type semiconductor layers. The intermediate layer has a lower conductivity than the surrounding p-type and n-type semiconductor layers and may be an intrinsic, compensated, or lower doped semiconductor layer. One example of this is the p-i-n diode, which includes a p-type layer, an n-type substrate, and a cavity. In addition, the p-i-n diode has an intrinsic semiconductor layer disposed between the p-type layer and n-type substrate. The depletion region extends through the intrinsic semiconductor layer, as well as into the p-type layer and n-type substrate. An intrinsic semiconductor layer may be doped several orders of magnitude less than either the p-type layer or n-type substrate.

In another embodiment, a bias resistor may be connected in series with the diode. The bias resistor is added to minimize the effect of photons generated in the cavity having sufficient energy to be absorbed in the reverse-biased junction (i.e. larger than the bandgap energy), thereby increasing the reverse bias current. The bias resistor thus regulates the light output of the device. Alternatively, the self-ballasting nature of these devices, described below, may be used to regulate the light output.

As one example of an application of the above embodiments, a semiconductor laser may be formed in which the structures above may be placed within a standard optical resonator having a pair of mirrors. The discharge light emitted from the ends of the cavity is coupled to the resonator and lasing can be obtained. These lasers can generate ultraviolet ($N_2$, rare gas halide excimers), visible, or infrared radiation that may be used in materials processing or atmospheric diagnostic applications.

Figure 4A:
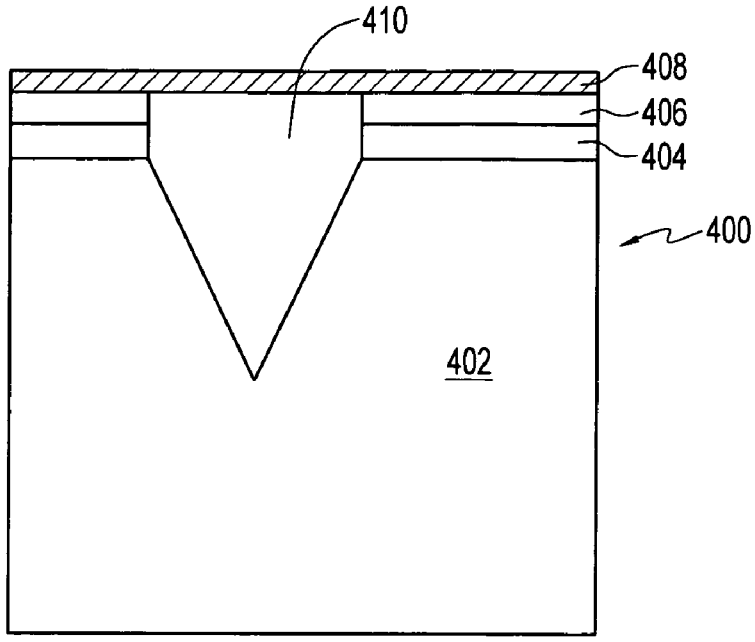
FIGS. 4*a* and 4*b* illustrate cross-sectional and top views of an embodiment of the microdischarge device of the present invention.
Figure 4B:
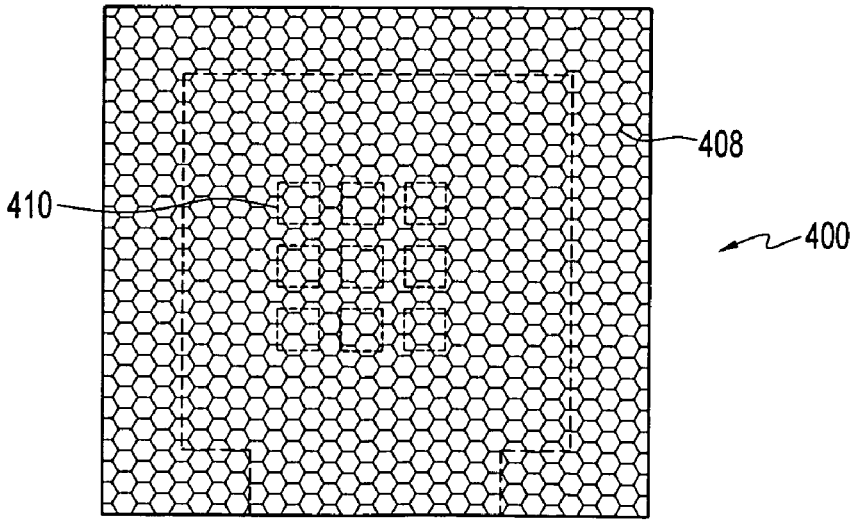

In another embodiment, shown in FIG. 4*a*, the microdischarge device 400 includes an intermediate layer 404 and a conducting screen electrode (or screen) 408 that is in contact with and extends across the conductive layer 406. The screen 408 improves both the lifetime and light output of the microdischarge device 400, making it more efficient by allowing the device to operate at lower voltages and producing greater light output power at the same power. The screen 408, as shown in FIG. 4*b*, preferably has openings that are comparable to or smaller than the area of the cavity 410. The semiconductor layer 402, the intermediate layer 404 and the conductive layer 406 may all be formed from the same materials and in the same manner as the analogous layers above.

The lifetime ($t_L$) is defined as the time, under continuous operation conditions, from maximum initial output power ($M_{top}$) at time $t=t_0$ to when the maximum output power of the device ($M_{op}$) (or any device in an array of devices) becomes ½ of the maximum achievable output power of the device ($M_{aop}$). Note that the maximum achievable output power of the device typically occurs some time after initial output. This is to say that the lifetime is defined as $t_L=t_{(2*Mop=Maop)}-t_0$. The lifetime is at least 10 hours and preferably at least 20 hours.

Although FIG. 4*a* depicts the screen 408 mounted on the conductive layer 406, the screen 408 may be mounted onto either (or both) the semiconductor layer 402 or the conductive layer 406, as long as the screen 408 covers at least a portion of the cavity 410. Similarly, although not shown, the screen may replace the conductive layer 406. The screen 408 presents a more uniform electrostatic potential to the discharge in the cavity 410 as the screen 408 partially covers the hole in the layer. The result of this is that the emission intensity of the discharge from the end of the cavity 410 of microdischarge devices 400 in which the screen 408 is present is an order of magnitude or more larger than the emission intensity when a screen 408 is not present.

Note that, in addition to light being emitted from the cavity, electrons may also be extracted from the cavity, thereby forming a plasma cathode. Further, an electroluminescent material or phosphor may be disposed on the screen or onto a non-conducting window adjacent to the screen. In this case, electrons may be generated in the cavity by the voltage potential either in a depletion region or in a dielectric layer. The majority of the electrons are then extracted from the cavity through the screen and then impinge upon the phosphor, which luminesces. An additional embodiment inserts a non-conducting layer between the screen and the conducting layer. This would allow one to operate the microdischarge continuously but illuminate the phosphor only when a voltage pulse is applied between the dielectric layer and the screen that would attract the electrons towards the screen. Alternatively, a conducting electrode that traverses the entire microdischarge device or an array of microdischarge devices may replace the screen and present a uniform potential surface to the cavity. An advantage of this embodiment is that the light output of the microdischarge device is not limited by the openness of the screen.

Preferably, screens are constructed of a metal such as Ni, Au, or Cu, which are available commercially as sample holders for Transmission Electron Microscopy (TEM) and are chosen such that most of the light reaching the screen from the microdischarge passes through the screen. The thickness of the screen may range from 10 Å–10 mm, and preferably ranges from 1 μm–500 μm including 10 Å–10 μm, 10 Å–1 μm, and 10 Å–1 μm, dependent on the diameter of the cavity. In one example, the thickness of the screen is comparable to that of the conductive layer. Other conductive materials may also be used to form a conducting electrode over the cavity. Such materials include indium tin oxide (ITO), which does not substantially absorb visible light.

Figure 5:
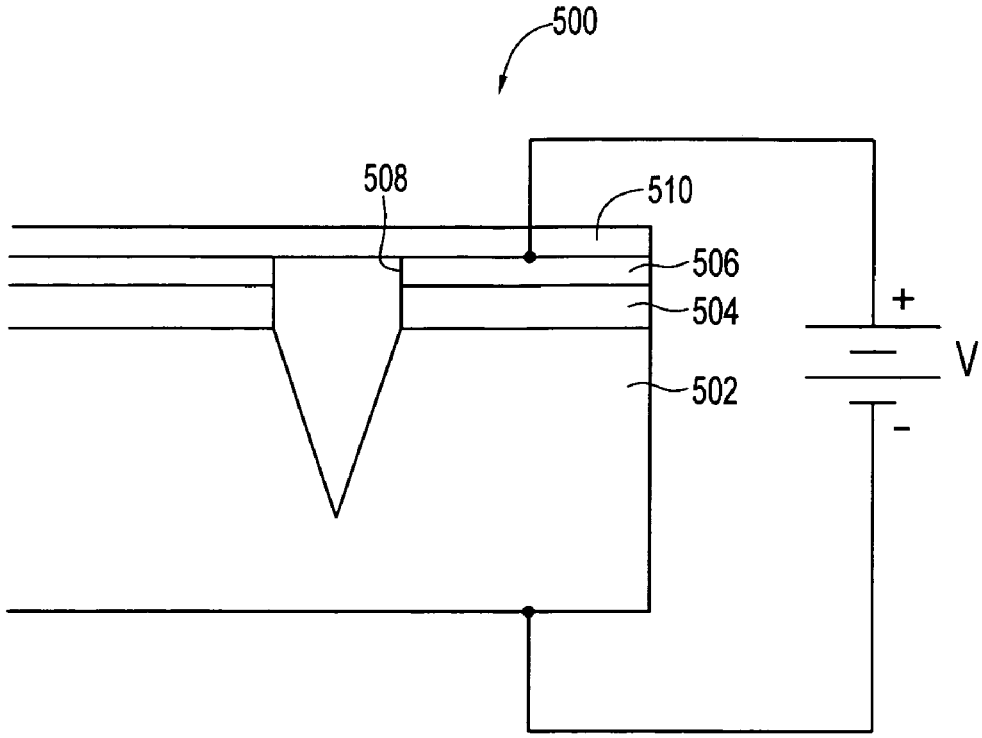
FIG. 5 is a cross-sectional view of an embodiment of the microdischarge device of the present invention.

In another embodiment, shown in FIG. 5, the microdischarge device 500 is similar to that of FIG. 2. In addition to having a semiconductor layer 502, an intermediate layer 504, a conductive layer 506 and a cavity 508 formed in the intermediate layer 504 and the semiconductor layer 502, a sealing material 510 is added. The sealing material 510 is formed from an optically transmissive material and is preferably flexible. The optically transmissive material does not significantly absorb emissions from the device 500 at the wavelengths of operation.

A conventional plastic laminate, glass, quartz or mica may be used to seal the device 500. One problem with the plastic laminate is that the plastic outgasses impurities into the gas in the cavity 508 and limits the lifetimes of laminated microdischarge device 500. However, the lifetime of the gas is not a fundamental limitation on the device lifetime. For example, the lifetime of the microdischarge device 500 will increase when using sealing materials that outgas less. Similarly, depositing (or otherwise disposing) a thin transmissive film such as tantalum oxide or glass onto conventional laminating sheets will impede or eliminate the outgassing process and extend the lifetime of the microdischarge device 500. Another alternative may be a vacuum baking procedure to significantly reduce the outgassing of conventional laminate sheets. As above, a screen and/or electrode/dielectric layer may be added to the basic structure before sealing. A phosphor/electroluminescent material may also be included on the screen before sealing.

The cavity may be sealed while containing the desired gas at the proper pressure by laminating a plastic sheet on to one or both sides of the microdischarge device or array, thereby sealing the microdischarge device while still allowing the generated light to pass through the sealing material. Another method is to "hard seal" the devices to a quartz window having a conducting film or a fine metal grid on one side. The bonding process takes place with the conductor facing the electrode or lower semiconductor layer and bonding occurs along the entire perimeter thereof. When completed, this structure is robust and compact, requiring only electrical connections to an appropriate power supply or supplies.

One method of fabrication of the sealed microdischarge device having additional electrode and dielectric layers is to mechanically assemble the various layers on the substrate by individually positioning or forming the dielectric layer and electrode and/or screen on the substrate and subsequently forming the cavity by etching or laser micromachining. Alternatively, the cavity may be pre-formed in the various layers and then aligned during assembly. After the layers have been assembled and the cavity formed, the cavity may then be filled with a specified amount or pressure of a selected gas and then sealed while containing the desired gas at the proper pressure.

Figure 6:
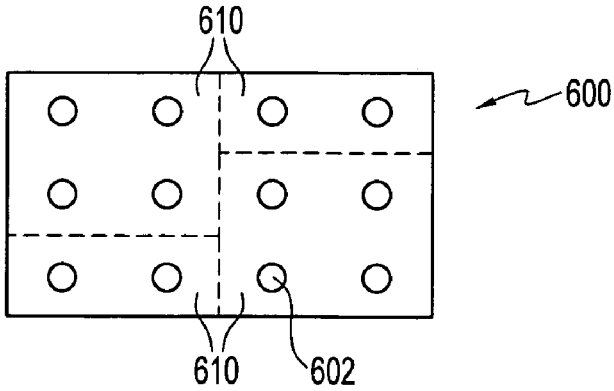
FIG. 6 is a top view of an array of an embodiment of the microdischarge devices of the present invention.

The above embodiments have focused on a single microdischarge device; however, as shown in FIG. 6, a plurality of microdischarge devices may be assembled into a planar array of devices 600. The individual devices 602 in the array 600 may be formed from any of the above embodiments.

A number of applications of microdischarge technology are accessible with these thin, low cost microdischarge arrays. Custom lighting and gas chromatography are examples of industrial applications that would be ideally suited for such a technology. To determine the composition of a gas, for example, the gas is allowed to flow laterally between a planar array of microdischarge devices and an opposing planar array of detectors. Each detector has an optical axis that coincides with the corresponding microdischarge device and has a filter that transmits a particular wavelength or set of wavelengths (i.e. a bandpass, low-pass or high-pass filter). Only particular wavelengths are transmitted by the gas, while others are absorbed. Thus, each detector detects light of a particular wavelength generated by the microdischarge devices and passing through the gas present. As the gas to be tested enters each microdischarge, it is energized (excited) and emits light at wavelengths characteristic of the particular gas components. Each detector, then, would observe a particular wavelength region, enabling the composition of the gas flow stream (or the presence of impurities in the gas flow stream) to be determined.

One method to determine the composition is to have the planar array emit light of a broad set of wavelengths and vary the filters of the corresponding detectors. Another method to determine the composition is to vary the wavelength of the light emitted from the microdischarge devices in the planar array, perhaps by varying the gas that fills the microdischarge devices, and having the same filter for each corresponding detector. In either case, data are collected and the composition of the gas is determined from the transmission/absorption spectra of the gas. The microdischarge devices may emit either incoherent light (such as the custom lighting arrays above) or coherent light (as described by the lasers described below). Alternately, these methods may be combined—that is, various sets of microdischarge devices in the array could emit light of the same wavelength, with each set emitting light of a different wavelength from another set. In this case, various filters may be used to transmit light to the detectors.

In another application, the array of microdischarge devices may be used in the remediation of toxic gases. This application entails flowing a gas that is environmentally hazardous or toxic through the cavities to break down the gas into benign products. Alternatively, the products of the gas discharge can be reacted with a titration gas ($O_2$, $N_2$, etc.) to produce a benign product rather than being completely broken down. In this application, the flow of the hazardous/toxic gas through the cavity is imperative and thus, the microdischarge devices would not be sealed by a laminate. Note that in some applications, such as chemical sensors, only a few tens of individual devices may be required, while in other applications, such as industrial lighting, tens of thousands to millions of individual devices may be required.

Ohmic losses become a problem if one wishes to fabricate large arrays of microdischarge devices. Large arrays often do not ignite uniformly; rather, devices at the perimeter of the array ignite preferentially. To overcome this problem, the overall array 600 may be divided into sub-arrays 610 and deliver power separately to the sub-arrays 610. The sub-arrays 610 may be independently excited such that they no longer ignite preferentially but in a desired arrangement. For example, while one voltage may be applied to a common substrate of the sub-arrays 610, different voltages may be applied to the upper semiconductor layer. Alternatively, the entire array may have multiple conductive leads from the voltage source and provided to selected areas of the array or may have continuous strips of the conductive leads crossing the array in a grid-like manner. Further, each device may be individually excited and ballasted. The latter may be accomplished with discrete components or by tailoring the electrical properties of the semiconductor layer. These arrangements are only examples of techniques that may be used to provide the desired uniformity to the array.

Such designs minimize ohmic losses in the electrodes as arrays increase in size and improve the characteristics and reproducibility for igniting the array or collection. In addition, these designs decrease the voltage variation appearing across individual devices in at least 10 of the devices in the array. This decrease is such that when a minimum voltage sufficient to cause discharging of at least 10 of the devices is applied then the voltage difference between the first and second electrodes at every cavity of the microdischarge devices has a voltage difference of no more than 20% of the average voltage difference. The lower the voltage difference between a desired set of devices in the array, the better the uniformity in emission. Thus, more preferably the voltage difference may be no more than 10%, 5%, 2%, or 1% of the average voltage difference of at least 10, 20, 50, 100, 1000 or 10,000 devices.

In addition to exciting the sub-arrays independently, if an electrode and dielectric layer combination is present, using a multiple film dielectric as the dielectric layer allows one to realize much larger arrays that are well behaved. The addition of a screen on top of the electrode or replacing the electrode with a screen still further improves device and array characteristics, as discussed below.

EXAMPLES

Devices were fabricated in p-type silicon (100) wafers having a resistivity of 6–8 Ω-cm and a typical thickness of 300 μm. Pyramidal cavities, 50 or 100 μm square at the base and of 35 μm or 70 μm depth, respectively, were fabricated. The cavities were produced by anisotropic wet etching in a 33% (wt/wt) solution of KOH in water. Subsequently, the device dielectric was formed by spin coating an approximately 7.5–8 μm thick layer of a dry etchable polyimide (Dupont 2611, relative permittivity $\in_r$=2.9) onto the silicon surface followed by curing the polymer at 300° C. in a $N_2$ atmosphere. Subsequently, a 1200–2400 Å thick Ni film was e-beam evaporated onto the polyimide to serve as the anode. The discharge channels in the metal anode and dielectric films were defined photolithographically with a Cr mask and etched by wet and reactive ion etched ($O_2$ plasma) processes, respectively. Some devices additionally had $SiO_2$ or $Si_3N_4$ films of about 1500 Å thickness sandwiched between the silicon wafer and the polyimide.

Figure 7A:
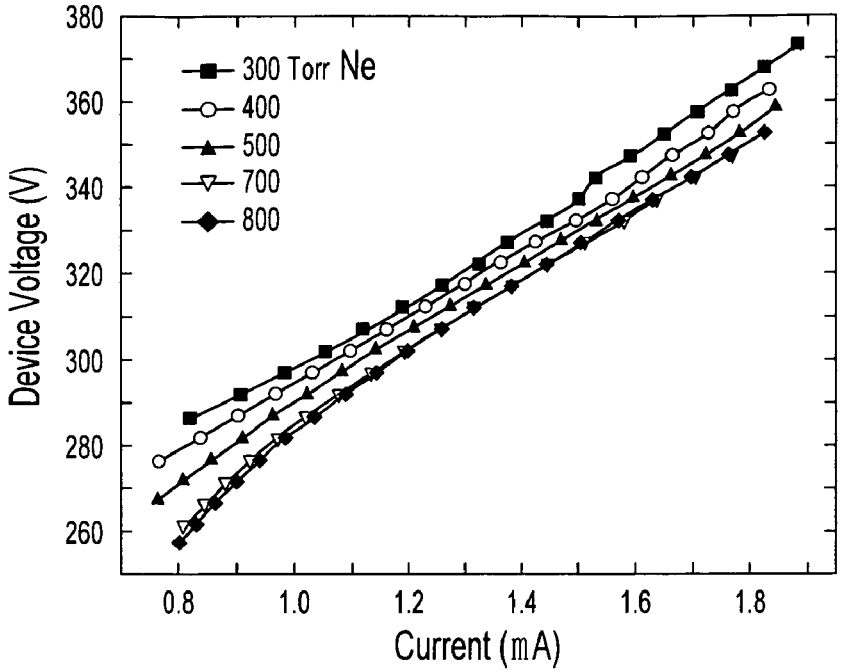
FIG. 7*a* and 7*b* illustrate V–I characteristics for several different Ne gas pressures in a conventional microdischarge device having a planar cathode and an embodiment of the microdischarge device of the present invention.
Figure 7B:
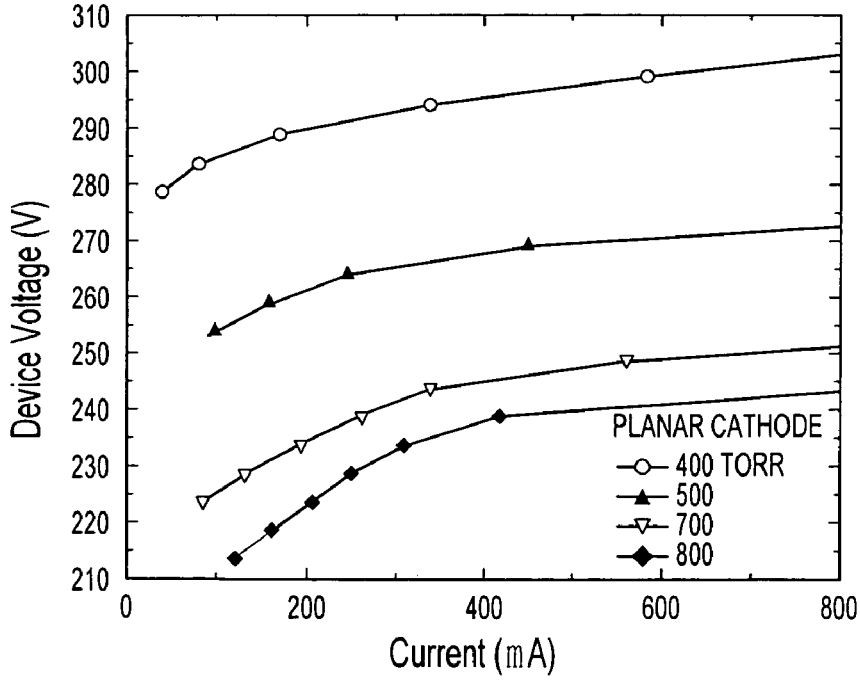

FIGS. 7*a* and 7*b* illustrate V–I data for a conventional single device having planar cathode and a single device having a $(50\ \mu m)^2$ square pyramidal silicon cathode, respectively, at Ne gas pressures between 300 and 800 Torr. Stable operation of both single devices and arrays is observed up to the highest gas pressures measured so long as the silicon acts as the cathode; if the polarity applied to the device is reversed, i.e. if the silicon pyramid serves as the anode, the device operation is unstable. Operating voltages as low as 260–290 V for a single device was observed and the saturation voltage is inversely proportional to the gas pressure. The differential resistance is positive and is approximately $2\times10^8$ Ω, i.e. about four orders of magnitude larger than that of conventional silicon or Mo cylindrical hollow cathode microdischarge devices. Differential resistances of between 10 kΩ and 10 MΩ have been demonstrated.

One advantage of a large positive differential resistance is that the device has a self-limiting current. In addition, the power consumption of the device decreases. As illustrated in FIG. 7*b*, the device also exhibits linear V–I characteristics over the entire range of gas pressures. Advantages of this linearity include possible elimination of external ballast and simplification of external control of the device.

In addition, unlike conventional microdischarge devices, the voltage across the device does not fall when ignition of the discharge occurs. One explanation may be the combination of the dielectric constant of the polyimide used being considerably smaller than that of other similar polyimide dielectrics reported recently ($\in_r$=3.8) coupled with the large positive differential resistance. The increase in cathode surface area afforded by the pyramidal device and the formation of a shallow hollow cathode (relative to the conventional planar structure) may account for differences between V–I characteristics as well as the differential resistance of the above device and that of a conventional planar silicon cathode. Note that the depth of the shallow cavity may be not more than a few hundred microns, whereas the conventional hollow cathode structure may have much deeper depths of at least 500 μm–5 mm.

Thus, one important attractive feature of the present thin film microdischarge devices is the versatility in tailoring the electrical properties of devices, including the capacitances and isopotential profiles.

Figure 8:
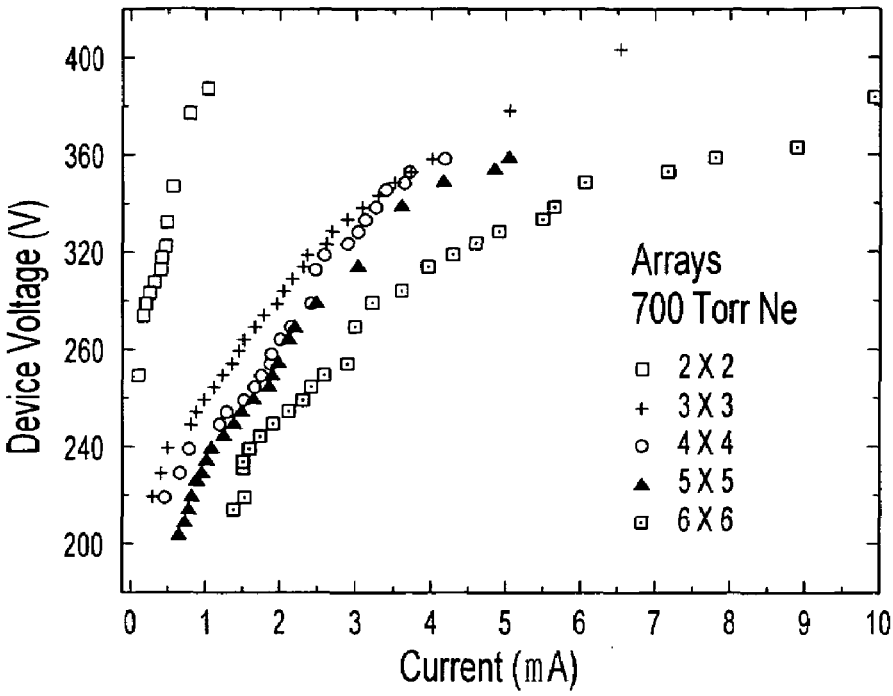
FIG. 8 illustrates V–I characteristics for several different array sizes in an embodiment of the microdischarge device of the present invention.
Figure 9:
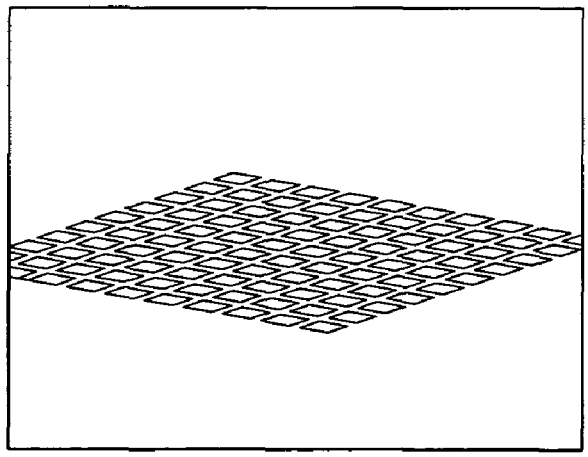
FIG. 9 is a drawing depicting an SEM photograph of an array in an embodiment of the microdischarge device of the present invention.

Arrays of up to 10×10 devices have been fabricated and V–I data for arrays ranging from 2×2 to 6×6 are presented in FIG. 8. All of the arrays contain devices similar to those of FIG. 7*b*, having 50 μm square pyramidal silicon cathodes separated by 50 μm. The cavities were filled with Ne at 700 Torr and have a ballast resistance of 56 kΩ. Stable glow discharges were obtained for Ne pressures beyond 1 atm, in contrast with arrays of 400 μm diameter conventional planar silicon cathode devices that were unstable for gas pressures of even a few hundred Torr. Operating voltages as low as 200 V were observed for a 5×5 array (210 V for a 6×6 array). The Ne emission spectra produced by these arrays show strong emission from the singly-charged Ne ion in the 300–370 nm region even for pressures of several hundred Torr. Ignition of a common anode 3×3 array filled with Ne at 700 Torr occurred at 218 V and 0.35 μA. Optical micrographs of this array as well as larger arrays show that the emission from each discharge is spatially uniform. A drawing depicting an SEM image of a 10×10 array is shown in FIG. 9.

Eight 3×3 arrays with different device spacings were fabricated to investigate the dependence of the power consumption of the array on interdevice separation. With a Ne gas pressure of 740 Torr, increasing the interdevice separation from 50–170 μm revealed a decrease of about 6% in the starting voltage at an interdevice separation of 100 μm followed by a gradual decrease for larger spacings and a concomitant doubling of the current drawn by the array. Ohmic losses in the silicon cathode wafer and non-simultaneous device ignition are responsible for this result.

Lifetime tests on multiple (8) present 3×3 arrays show lifetimes of at least 20 hours of continuous operation with powers of 70% of the maximum power. The output power is in the μW range owing to the μA currents drawn by the devices but little degradation in performance is observed prior to failure. For example, an array of 50 μm square pyramidal cavities separated by 50 μm and operating at a Ne gas pressure of 700 Torr produced 5.1 pW of radiation in the 300–800 nm region, measured in a solid angle of $4.5\times10^{-2}$ sr. The power fluctuated in this array by no more than about 4% from this value in a four hour period after warmup. The lifetime may be limited by residue left in the pyramids by the etching process, vaporization or sputtering of the thin anode layer. Anodes of larger cross-sectional area and the use of more robust materials, such as polysilicon, may extend these lifetimes.

Figure 10:
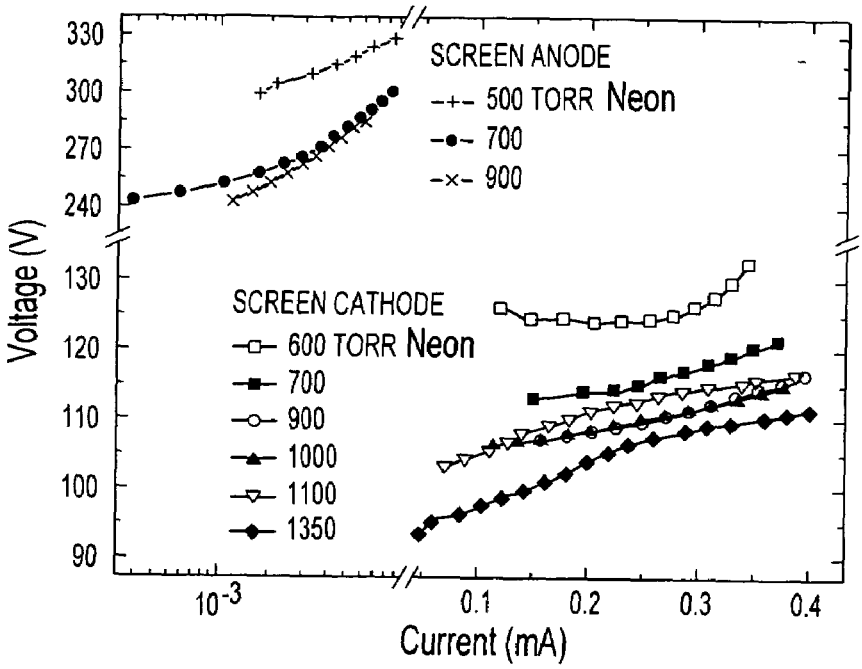
FIG. 10 illustrates V–I characteristics for several different Ne gas pressures in embodiments of the microdischarge device of the present invention.

Further V–I results of arrays in which a screen electrode replaces the conductive layer and the silicon serves as either the cathode or the anode are shown in FIG. 10. The replacement of the conductive layer with the screen reduces the device operating voltage by about a factor of two and increases the radiant output power by about an order of magnitude. Stable and continuous glow discharges were produced at Ne pressures of up to 1350 Torr and voltages below 95 V. The fabrication steps were the same as those above except that rather than depositing the Ni film, a 17 μm Ni screen having 22 μm wide hexagonal openings was chemically bonded onto the surface of the device and the finished device or array was soft-baked for eight hours under vacuum. After evacuating the devices to a base pressure of approximately $10^{-7}$ Torr, they were backfilled with Ne.

Devices in which the screen electrode serves as the cathode have superior operating characteristics to devices in which the screen electrode serves as the anode. These results are the exact opposite of the above devices in which the conducting layer is solid. The V–I characteristics in the to lower right hand part of FIG. 10, representing devices in which the screen serves as the cathode, shows operating voltages as low as about 95 V.

However, if the screen serves as the anode, the V–I data shown in the upper left hand part of FIG. 10 is observed. As shown, in this case the operating voltages rise to between 240 and 330 V for Ne pressures of 500–900 Torr. Thus, both the screen electrode and the pyramidal electrode play a role in the steep decline in operating voltage. In conventional devices having a planar silicon electrode, in comparison, the lifetime is much shorter and the starting voltages are in excess of 250 V. Similarly, devices having 100 μm square pyramids, the operating voltages are 124–148 V for currents between 25 and 250 μA and Ne pressures of 50–1100 Torr.

Figure 11:
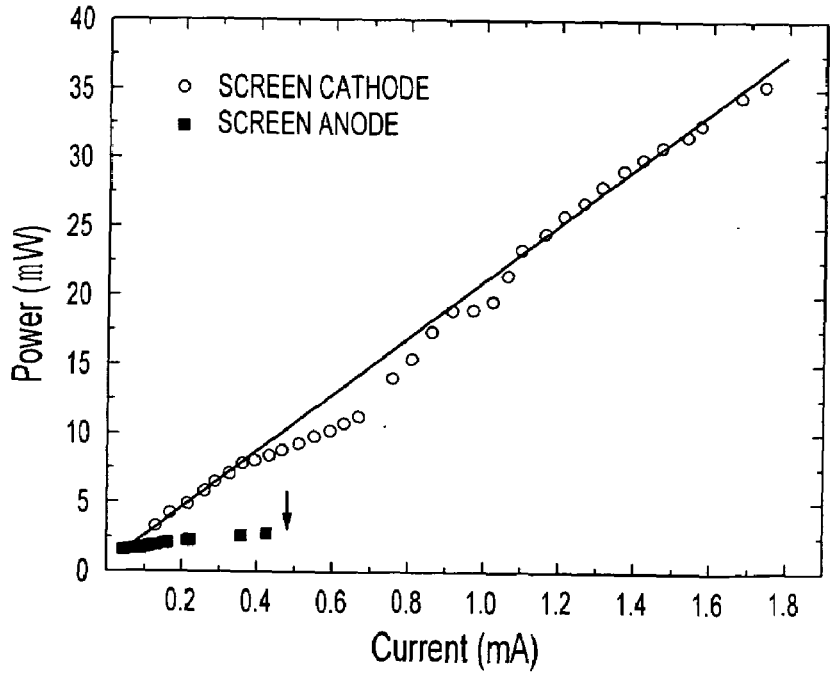
FIG. 11 illustrates radiant power output for embodiments of the microdischarge device of the present invention.

FIG. 11 shows the increase in radiant output power when the screen electrode acts as either the anode or cathode. For a 100 μm square silicon device operating at 500 Torr, the output power in the 300–800 nm region when the screen is the anode saturates at less than 3 μW and the devices fail regularly when the current exceeds about 0.4 mA. When the screen is the cathode, the output power varies roughly linearly and shows no sign of saturation; the power produced was about 34 μW in a solid angle of $4.5\times10^{-2}$ sr, obtained at a current of 1.8 mA, which corresponds to a radiative efficiency of about $10^{-4}$. The highest efficiencies were observed at 500–600 Torr and device currents of less than 0.2 mA.

The overall discharge when the screen is the cathode can be viewed as a number of smaller discharges acting in parallel, with higher current levels requiring additional cathode screen area. Each of the openings associated with the screen shown in FIG. 10*a* generates about 13 μA of current and corresponds to an average current density of about 2.5 $A\text{-}cm^{-2}$. Thus, a tradeoff exists between discharge current and the dimensions of the glow transverse to the discharge axis, i.e. the greater the pixel resolution, the smaller the limit on the current. Note that the screen openings shown are hexagons, but other openings such as squares or circles, may be used.

When the screen acts as an anode, the devices ignite individually as the applied voltage is increased. Thus, arrays operating with the screen as the cathode produce considerable output power and exhibit superior ignition characteristics but have relatively shorter lifetimes than arrays operating with the screen as the anode because of the power dissipated in the array.

While the invention has been described with reference to specific embodiments, the description is illustrative of the invention and not to be construed as limiting the invention. Various modifications and applications may occur to those skilled in the art without departing from the true spirit and scope of the invention as defined in the appended claims.

We claim:

1. A microdischarge device, comprising:

a first layer having a tapered cavity disposed therein;

an intermediate layer on the first layer; and a second layer on the intermediate layer, the intermediate layer electrically insulating the first layer from the second layer, the first and second layers having a conductivity larger than that of the intermediate layer;

wherein the cavity extends through at least a surface of the second layer.

2. The microdischarge device of claim 1, wherein the first layer is a semiconductor.

3. The microdischarge device of claim 2, wherein the first layer comprises Si.

4. The microdischarge device of claim 1, wherein the intermediate layer comprises at least one dielectric layer.

5. The microdischarge device of claim 4, wherein the first layer comprises Si.

6. The microdischarge device of claim 4, wherein the lifetime of the device is at least 10 hours.

7. The microdischarge device of claim 4, wherein the intermediate layer comprises a plurality of dielectric layers, at least two of the plurality of dielectric layers having different dielectric constants.

8. The microdischarge device of claim 1, further comprising a gas disposed in the cavity.

9. The microdischarge device of claim 1, further comprising an optically transmissive material that seals the cavity.

10. The microdischarge device of claim 1, wherein the first layer serves as a cathode of the microdischarge device.

11. An array comprising a plurality of microdischarge devices according to claim 1.

12. The array of microdischarge devices of claim 11, wherein the array is divided into independently excited sub-arrays.

13. A lighting array comprising the array of microdischarge devices according to claim 11.

14. A laser comprising a plurality of the microdischarge devices according to claim 1.

15. The microdischarge device of claim 1, wherein the cavity has trapezoidal cross-section.

16. A microdischarge device, comprising:

a first layer having a tapered cavity disposed therein;

an intermediate layer on the first layer; and a second layer on the intermediate layer, the intermediate layer electrically insulating the first layer from the second layer, the first and second layers having a conductivity larger than that of the intermediate layer;

wherein the cavity has an inverted square pyramidal shape.

17. A microdischarge device, comprising:

a first layer having a tapered cavity disposed therein;

an intermediate layer on the first layer; and a second layer on the intermediate layer, the intermediate layer electrically insulating the first layer from the second layer, the first and second layers having a conductivity larger than that of the intermediate layer;

wherein the first layer, the intermediate layer and the second layer form a diode, and the intermediate layer is a depletion region of the diode; and wherein the first layer is a semiconductor.

18. The microdischarge device of claim 17, wherein an angle of taper of the cavity is at least 20 degrees and at most 60 degrees.

19. The microdischarge device of claim 17, wherein an area of the cavity at a surface of the first layer is not greater than $10^4$ $\mu m^2$.

20. The microdischarge device of claim 17, wherein a depth of the tapered cavity in the first layer is not greater than 100 μm.

21. The microdischarge device of claim 17, wherein the first layer comprises Si.

22. The microdischarge device of claim 17, wherein the lifetime of the device is at least 10 hours.

23. A microdischarge device, comprising:

a first layer having a tapered cavity disposed therein;

an intermediate layer on the first layer; and a second layer on the intermediate layer, the intermediate layer electrically insulating the first layer from the second layer, the first and second layers having a conductivity larger than that of the intermediate layer;

wherein the intermediate layer comprises at least one dielectric layer; and wherein an angle of taper of the cavity is at least 20 degrees and at most 60 degrees.

24. A microdischarge device, comprising:

a first layer having a tapered cavity disposed therein;

an intermediate layer on the first layer; and a second layer on the intermediate layer, the intermediate layer electrically insulating the first layer from the second layer, the first and second layers having a conductivity larger than that of the intermediate layer;

wherein the intermediate layer comprises at least one dielectric layer; and wherein an area of the cavity at a surface of the first layer is not greater than $10^4$ $\mu m^2$.

25. A microdischarge device, comprising:

a first layer having a tapered cavity disposed therein;

an intermediate layer on the first layer; and a second layer on the intermediate layer, the intermediate layer electrically insulating the first layer from the second layer, the first and second layers having a conductivity larger than that of the intermediate layer;

wherein the intermediate layer comprises at least one dielectric layer; and wherein a depth of the tapered cavity in the first layer is not greater than 100 μm.

26. A microdischarge device, comprising:

a first layer having a tapered cavity disposed therein;

an intermediate layer on the first layer; and a second layer on the intermediate layer, the intermediate layer electrically insulating the first layer from the second layer, the first and second layers having a conductivity larger than that of the intermediate layer;

wherein side walls of the cavity are coated with a film that reflects light.

27. A microdischarge device, comprising:

a first layer having a tapered cavity disposed therein;

an intermediate layer on the first layer; and a second layer on the intermediate layer, the intermediate layer electrically insulating the first layer from the second layer, the first and second layers having a conductivity larger than that of the intermediate layer;

wherein the second layer comprises an electrically conducting screen disposed on an end of the cavity.

28. The microdischarge device of claim 27, wherein the screen serves as a cathode of the microdischarge device.

29. A microdischarge device, comprising:

a semiconductor layer having a tapered cavity disposed therein;

an intermediate layer on the semiconductor layer; and a second layer on the intermediate layer, the intermediate layer electrically insulating the semiconductor layer from the second layer;

wherein the cavity extends through at least a surface of the second layer.

30. The microdischarge device of claim 29, wherein the semiconductor layer comprises Si.

31. The microdischarge device of claim 29, wherein the second layer is a metal.

32. The microdischarge device of claim 31, wherein the semiconductor layer comprises Si.

33. The microdischarge device of claim 31, wherein the lifetime of the device is at least 10 hours.

34. The microdischarge device of claim 29, wherein the intermediate layer comprises at least one dielectric layer having a lower electrical conductivity than the semiconductor and second layers.

35. The microdischarge device of claim 29, further comprising a gas disposed in the cavity.

36. The microdischarge device of claim 29, further comprising an optically transmissive material that seals the cavity.

37. The microdischarge device of claim 29, wherein the semiconductor layer serves as a cathode of the microdischarge device.

38. An array comprising a plurality of microdischarge devices according to claim 29.

39. The array of microdischarge devices of claim 38, wherein the array is divided into independently excited sub-arrays.

40. A lighting array comprising the array of microdischarge devices according to claim 38.

41. A laser comprising a plurality of the microdischarge devices according to claim 29.

42. The microdischarge device of claim 29, wherein the cavity has trapezoidal cross-section.

43. A microdischarge device, comprising:

a semiconductor layer having a tapered cavity disposed therein;

an intermediate layer on the semiconductor layer; and a second layer on the intermediate layer, the intermediate layer electrically insulating the semiconductor layer from the second layer;

wherein the semiconductor layer, the intermediate layer and the second layer form a diode and the intermediate layer is a depletion region of the diode.

44. The microdischarge device of claim 43, wherein an angle of taper of the cavity is at least 20 degrees and at most 60 degrees.

45. The microdischarge device of claim 43, wherein an area of the cavity at a surface of the semiconductor layer is not greater than $10^4$ $\mu m^2$.

46. The microdischarge device of claim 43, wherein a depth of the non-cylindrical cavity in the semiconductor layer is not greater than 100 μm.

47. The microdischarge device of claim 43, wherein the semiconductor layer comprises Si.

48. The microdischarge device of claim 43, wherein the lifetime of the device is at least 10 hours.

49. A microdischarge device, comprising:

a semiconductor layer having a tapered cavity disposed therein;

an intermediate layer on the semiconductor layer; and a second layer on the intermediate layer, the intermediate layer electrically insulating the semiconductor layer from the second layer;

wherein the second layer is a metal; and wherein an angle of taper of the cavity is at least 20 degrees and at most 60 degrees.

50. A microdischarge device, comprising:

a semiconductor layer having a tapered cavity disposed therein;

an intermediate layer on the semiconductor layer; and a second layer on the intermediate layer, the intermediate layer electrically insulating the semiconductor layer from the second layer;

wherein the second layer is a metal; and wherein an area of the cavity at a surface of the semiconductor layer is not greater than $10^4$ $\mu m^2$.

51. A microdischarge device, comprising:

a semiconductor layer having a tapered cavity disposed therein;

an intermediate layer on the semiconductor layer; and a second layer on the intermediate layer, the intermediate layer electrically insulating the semiconductor layer from the second layer;

wherein the second layer is a metal; and wherein a depth of the cavity in the semiconductor layer is not greater than 100 μm.

52. A microdischarge device, comprising:

a semiconductor layer having a tapered cavity disposed therein;

an intermediate layer on the semiconductor layer; and a second layer on the intermediate layer, the intermediate layer electrically insulating the semiconductor layer from the second layer;

wherein the intermediate layer comprises at least one dielectric layer having a lower electrical conductivity than the semiconductor and second layers; and wherein the intermediate layer comprises a plurality of dielectric layers, at least two of the plurality of dielectric layers having different dielectric constants.

53. A microdischarge device, comprising:

a semiconductor layer having a tapered cavity disposed therein;

an intermediate layer on the semiconductor layer; and a second layer on the intermediate layer, the intermediate layer electrically insulating the semiconductor layer from the second layer;

wherein side walls of the cavity are coated with a film that reflects light.

54. A microdischarge device, comprising:

a semiconductor layer having a tapered cavity disposed therein;

an intermediate layer on the semiconductor layer; and a second layer on the intermediate layer, the intermediate layer electrically insulating the semiconductor layer from the second layer;

wherein the second layer comprises an electrically conducting screen disposed on an end of the cavity.

55. The microdischarge device of claim 54, wherein the screen serves as a cathode of the microdischarge device.

* * * * *

UNITED STATES PATENT AND TRADEMARK OFFICE

CERTIFICATE OF CORRECTION

PATENT NO. : 7,112,918 B2
APPLICATION NO. : 10/047469
DATED : September 26, 2006
INVENTOR(S) : J. Gary Eden et al.

It is certified that error appears in the above-identified patent and that said Letters Patent is hereby corrected as shown below:

In the Detailed Description of the Issued Patent:

| | |
|---|---|
| Col. 10, Line 52 | Before the word "dependent", please delete "10 Å -1 μm," and insert --100 Å -1 μm,-- therefor. |
| Col. 14, Line 47 | Please delete "5.1 pW" and insert --5.1 μW-- therefor. |

Signed and Sealed this

Seventeenth Day of June, 2008

JON W. DUDAS
*Director of the United States Patent and Trademark Office*